US006575396B2

(12) United States Patent
Leskinen

(10) Patent No.: US 6,575,396 B2
(45) Date of Patent: Jun. 10, 2003

(54) METHOD AND DEVICE IN WINDING OF A WEB

(75) Inventor: Arto Leskinen, Nukari (FI)

(73) Assignee: Metso Paper, Inc., Helsinki (FI)

( * ) Notice: Subject to any disclaimer, the term of this patent is extended or adjusted under 35 U.S.C. 154(b) by 103 days.

(21) Appl. No.: 09/952,731

(22) Filed: Sep. 14, 2001

(65) Prior Publication Data

US 2002/0033431 A1 Mar. 21, 2002

Related U.S. Application Data

(63) Continuation-in-part of application No. PCT/FI00/00211, filed on Mar. 16, 2000.

(30) Foreign Application Priority Data

Mar. 17, 1999 (FI) ..... 990595

(51) Int. Cl.[7] ..... B65H 18/14
(52) U.S. Cl. ..... 242/541.4; 242/541.7
(58) Field of Search ..... 242/541.5, 541.6, 242/541.7, 541.4, 542.3

(56) References Cited

U.S. PATENT DOCUMENTS

| | | | |
|---|---|---|---|
| 3,568,944 | A | 3/1971 | Besserdich |
| 4,465,244 | A | 8/1984 | Karr |
| 4,601,435 | A | 7/1986 | Tomma et al. |
| 5,732,902 | A | 3/1998 | Tomma et al. |
| 5,888,359 | A | 3/1999 | Suominen |
| 5,961,065 | A | 10/1999 | Tomma et al. |

FOREIGN PATENT DOCUMENTS

| | | |
|---|---|---|
| FI | 100467 | 12/1997 |
| FI | 100468 | 12/1997 |
| WO | WO 93/06034 | 4/1993 |
| WO | WO 00/55078 | 9/2000 |

OTHER PUBLICATIONS

PCT International Preliminary Examination Report for PCT/FI00/00211.

*Primary Examiner*—John Q. Nguyen
(74) *Attorney, Agent, or Firm*—Lathrop & Clark LLP

(57) ABSTRACT

A web roll is wound (11) by passing the web onto a core (12) via a pressure nip (N) formed between a winding drum (10) and the roll (11), whereby the core (12) is supported by chucks (14) mounted on roll support arms (13). The pressing-nip force in the nip (N) formed between the roll (11) and the winding drum (10) is controlled using a position-feedback technique in which the movements of the roll support arms (13) are synchronized. Moreover, the support arms are moved is response to a control unit which uses a physical model of the winding process which predicts roll diameter at any time. When force sensors which detect an increase in pressure the arms can be advanced to promote even winding of the roll.

19 Claims, 1 Drawing Sheet

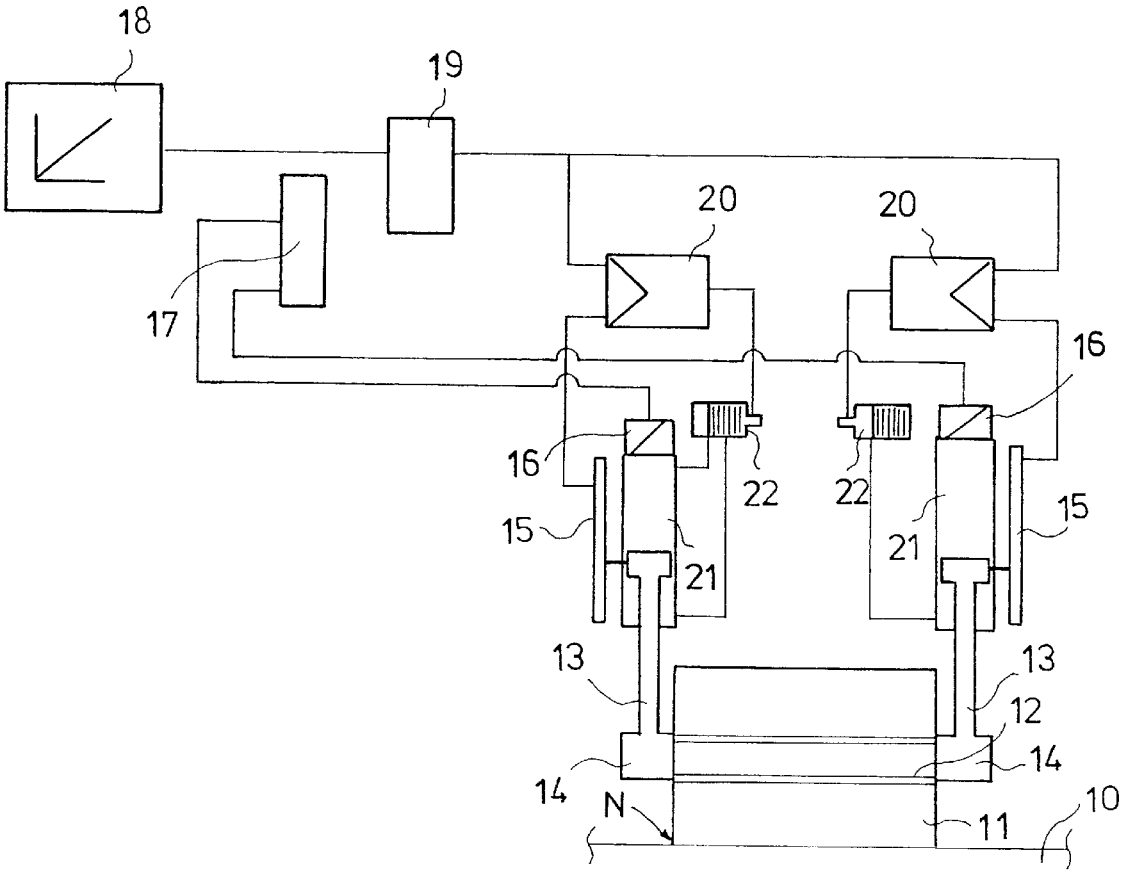
18
19
20
20
17
16
16
22
22
15
21
21
15
13
13
12
14
14
N
11
10

METHOD AND DEVICE IN WINDING OF A WEB

CROSS REFERENCES TO RELATED APPLICATIONS

This application is a continuation-in-part of PCT Application No. PCT/FI00/002111, filed Mar. 16, 2000, and claims priority on Finnish Application No.990595, filed Mar. 17, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method in winding a web, in which method a roll is wound by passing the web onto a core via a pressure nip formed between a winding drum and the web roll being wound, whereby the core element is supported by means of chucks mounted on the web roll support arms.

The invention also concerns a device for winding a web, said device being designed for use in winding the web into a roll onto a core via a pressure nip formed between a winding drum and the web roll being wound, whereby the core element is supported by means of chucks mounted on the web roll support arms.

As known in the art, the web roll is supported in center-driven winders by chucks inserted in the center of the core. The chucks are mounted on the web roll support arms that are adapted laterally movable into preset positions. In some winder designs, the winding nip pressure is controlled by applying to both of the cylinders that support the web roll from its ends an equal line pressure, that is, having the cylinders connected in parallel, while in certain other designs each winder arm is controlled separately based on feedback signals obtained from sensors. A problem hampering these conventional winder constructions is that sometimes a circumferential ridge or bump will form on the web roll which causes a lateral, i.e. a side-to-side, inclination of the roll, whereby a pressure- or force-controlled feedback arrangement may result in telescoping of the roll. Obviously, this results in an unbalanced roll.

As known by those skilled in the art, this complication occurs chiefly so that the circumferential ridge gradually forming on the roll causes the roll to tilt, that is to become cone shaped, so that the pressure nip opens at one end while the other end is subjected to a high nip pressure, whereby one of the roll support arms remains higher or further from the roll axis of rotation than the other support arm when the winding operation is completed.

In regard to the prior art, reference is made to FI Pat. No. 100467, owned by the applicant, wherein a method is disclosed for use in winding a web, in which method the winding of the web takes place supported on a carrier roll onto a core via a pressure nip formed between the carrier roll and the paper roll being wound. In this prior-art method, the core rotates at least partially supported and the core/roll is supported and/or loaded by a device whose position is adjustable. During the initial stage of winding, the loading/support element(s) of the device is/are transferred by an essentially linear movement in a plane substantially passing through the axes of the carrier roll and the paper roll being wound thus accomplishing the loading and/or supporting of the roll being wound in the winding station. With the progress of the winding operation, the loading/support element(s) is/are moved downwardly along a trajectory which is substantially compliant with the perimeter of the roll being wound and, at the final stage of winding, the roll being finished is supported from below by said element(s). By virtue of said element(s), the loading and/or support force imposed on the roll being wound is controlled chiefly by the pressure nip force and the surface-drive force.

SUMMARY OF THE INVENTION

The invention is a method of controlling the position of the arms that support a web roll in engagement with a winding drum. The arms are controlled by a combination of a control unit which, based on a physics model of the winding process, predicts the roll diameter at any point in time, and force sensors mounted on the arms which detect an increase in force. The measured increase in force is used by a force feedback circuit, and the output of the feedback circuit is monitored in a feedback control unit which also receives a signal from the control unit about the predicted web roll diameter. From the feedback control unit, information is passed to parallel-operating position controllers that control the position of the roll support arms via a steering control unit which controls loading of the web roll by the hydraulic cylinders to increase the rate at which the arms move the web roll away from the winding drum, to thus prevent excessive pressure. The arms can also be controlled by electrical or mechanical means to move synchronously so as to prevent the web roll from becoming cone shaped.

It is an object of the invention to provide a method and a device capable of overcoming the complications caused by a circumferential ridge or bump which sometimes forms on a web roll as it is being wound.

It is a further object of the invention to provide a method and a device offering easier and more accurate control of the web roll structure resulting from a winding operation.

To achieve the above-stated goal and others to be described later in the text, the method according to the invention is generally characterized in that the pressing force of the nip formed between the web roll being wound according to the method and the winding drum is controlled by a position-feedback technique based on synchronized movements of the roll support arms.

Furthermore, the device according to the invention is generally characterized in that said device includes means for controlling the pressing-nip force in the nip formed between the roll and the winding drum using a position-feedback technique in which the movements of the roll support arms are synchronized.

According to the invention, the pressing-nip force is controlled using a position-feedback technique in which the movement of the roll support arms is synchronized with the help of, e.g., electrical, mechanical or hydraulic means. Mechanical synchronization can take place via, e.g., the core or the chucks, while hydraulic synchronization can be implemented using series-connected cylinders. Electrical synchronization in turn, however, has been found the most cost-efficient technique of implementing such a synchronization. According to a preferred embodiment of the invention, the implementation can be such that, e.g., one of the roll support arms is controlled by a force-feedback loop, while the other arm controlled by a position-feedback loop follows the movement of the force-controlled arm. This arrangement represents a simple electrical synchronization.

Herein arises a minor risk from the possible occurrence of the circumferential ridge on the side of the position-controlled arm, whereby the structure of the wound roll may remain inferior. It is, however, possible to eliminate this risk. According to a preferred embodiment of the invention, the implementation of the electrical synchronization can be such that both arms are controlled in parallel by a position-feedback loop as a function of the roll diameter increase rate and the pressing force of the nip is taken into account as a correction term in the control loop. Advantageously, the pressing force of the nip is measured at both arms and the correction term can be formed as, for example, the sum, maximum or average value of both measurement signals. Thus, an increase of the nip force causes the center of the roll being wound to be offset from the nip at a faster rate. The results being disturbances will be effectively compensated for on either side of the roll being wound.

According to the invention, both of the roll support arms can be mechanically synchronized to each other via, e.g., the core or, alternatively, by electrical means such as a control loop in which one of the arms is controlled by a force-feedback loop and the other is synchronized to move therewith controlled by a position-feedback loop. By virtue of the control arrangement according to the invention, the structure of the roll being wound becomes easily manageable due to the above-described synchronized control of the roll support arms that allows the pressing-nip force to be controlled by a position-feedback loop.

Particularly advantageously, the invention is suited for use in conjunction with the method and apparatus disclosed in cited FI Pat. No. 100,468 owned by Metso Paper, Inc., the assignee of this application, wherein the prior-art loading/supporting arrangement can be complemented with the position-controlled center-loading technique according to the present invention for controlling the pressing-nip force.

In the following the invention will be described in greater detail with reference to the FIGURE of appended drawing to the details of which the invention is not by any means intended to be narrowly confined.

BRIEF DESCRIPTION OF THE DRAWINGS

Referring to the FIGURE, therein is schematically illustrated a winder having an embodiment of a control arrangement according to the invention adapted to function therewith.

DESCRIPTION OF THE PREFERRED EMBODIMENTS

As shown in the FIGURE, a paper roll 11 is being wound via a nip N formed between a winding drum 10 and the web roll 11 and the roll 11 is supported while being wound about a core 12 that is mounted via chucks 14 on roll support arms 13. To the roll support arms 13 are attached position and force measuring sensors 15, 16 from which the measurement signals are taken to a force-feedback circuit 17 whose output is monitored in a feedback control unit 19. A signal proportional to roll diameter is obtained from a control unit 18 which calculates roll diameter based on various physical parameters for example: speed of the paper web, the acceleration of the paper web, paper caliper, paper density, core diameter and nip force, which can be measured or otherwise determined. Generally it is possible to predict the future diameter of the web roll with respect to time based on the underlying physical relationships governing the formation of the web roll. Theoretically, if there were no faults in the web roll as it formed, the control unit 18 could calculate the roll diameter correctly so that the output of the control unit 18 alone could be used to control the support arms 13.

However, an ability to respond to the presence of an annular ridge in the roll is desirable. The presence of such an annular ridge is detected by the force measuring sensors 15, 16, by for instance the measured force beginning to increase. The rate of increase in diameter of the web roll as predicted by the control unit 18, is then increased to take into account the increase in force measured by the sensors 15, 16 through the feedback control unit 19.

Subsequently, the information is passed to parallel-operating position controllers 20 that control the position of the roll support arms 13 via a control unit 22 steering the loading of the roll with the help of, for example, hydraulic cylinders 21. The movements of the roll support arms 13 are electrically synchronized to each other so that both roll support arms 13 are driven in parallel by a position-feedback loop as a function of the roll diameter increase rate and the pressing force of the nip is taken into account as a correction term in the control loop.

According to the invention, the pressing-nip force is controlled by a position-feedback loop in which the movements of the roll support arms 13 are synchronized. Mechanical synchronization is implemented via, for example, the core 12 or the chucks 14, while hydraulic synchronization is accomplished with the help of series-connected cylinders, or differential gearbox motors. When electrical synchronization is used, for example, one roll support arm 13 is controlled by a force-feedback loop, while the other arm 13 is controlled by a position-feedback loop to follow the movement of the force-controlled arm. This arrangement accomplishes the electrical synchronization.

It should be understood that wherein chucks are described as being used to mount the web roll core to the arms 13, the term chucks should be understood to incorporate equivalent structures. Similarly the term core should be understood to incorporate equivalent structures, on which a web roll is formed, and the term differential gearbox motors will be understood to incorporate equivalent structures.

While the invention has been described with references to a few preferred exemplifying embodiments only, it is understood that the details thereof are not limiting to the scope of the invention. To those skilled in the art, a plurality of modifications and adaptations are obvious within the inventive spirit of the appended claims.

I claim:

1. A method for winding a web comprising the steps of;

winding a web roll by passing the web onto a core via a pressure nip formed between a winding drum and the web roll;

wherein the core is supported by chucks mounted on roll support arms, and wherein the pressing-nip force in the nip formed between the web roll and the winding drum is controlled using a position-feedback technique in which the movements of the roll support arms are synchronized and controlling the movements of said roll support arms so they are driven in parallel by a position-feedback loop as a function of a predicted rate of increase of the diameter of the roll, while the pressing nip force is used as a correction term to the predicted rate of increase.

2. The method of claim 1 wherein the movements of said roll support arms are synchronized by electrical means.

3. The method of claim 1 wherein the movements of said roll support arms are synchronized by mechanical means.

4. The method of claim 1 wherein the movements of said roll support arms are synchronized by hydraulic means.

5. The method of claim 1 wherein the pressing-nip force is measured at both roll support arms.

6. The method of claim 1 wherein the movements of said roll support arms are synchronized by electrical means so that one roll support arm is controlled by a force-feedback loop, while the other arm is controlled by a position-feedback loop to follow the movement of the force-controlled arm.

7. The method of claim 1 wherein the movements of said roll support arms are synchronized mechanically via the core or the chucks.

8. The method of claim 1 wherein the movements of said roll support arms are synchronized hydraulically by means of series-connected cylinders.

9. A device for winding a web for use in conjunction with winding a web roll onto a core via a pressure nip formed between a winding drum and the roll, whereby the core is supported by means of chucks mounted on roll support arms, and wherein said device includes means for controlling the pressing-nip force in the nip formed between the roll and the winding drum, wherein the means for controlling the pressing-nip force comprises:

a control unit which, based on a model of the winding process, predicts the web roll diameter, and produces a signal corresponding to web roll diameter;

at least one force sensor mounted on the arms which detects pressing-nip force;

a force feedback circuit, receiving input from the at least one force sensor; and a feedback control unit receiving the signal from the control unit about the predicted web roll diameter and constructed to apply the output of the force feedback circuit as a correction to the output of the control unit, the feedback control unit connected in controlling relation with parallel-operating position controllers that control the position of the roll support arms a via steering control unit which controls loading of the web roll.

10. The device of claim 9, wherein the movements of said roll support arms are synchronized by electrical means.

11. The device of claim 9, wherein the movements of said roll support arms are synchronized by mechanical means.

12. The device of claim 9, wherein the movements of said roll support arms are synchronized by hydraulic means.

13. The device of claim 9, wherein the device includes position and force measurement means.

14. The device of claim 13 wherein the device includes a pressing-nip force control unit for processing the signals obtained from said measurement means.

15. The device of claim 14 wherein the device includes a feedback control unit for processing the signals obtained from said pressing-nip force control unit and said control unit.

16. The device of claim 9 wherein the device includes a control unit for monitoring the rate of increase of the diameter of the roll being wound.

17. The device of claim 9 characterized in that the device includes position control units for controlling the position of said roll support arms.

18. The device of claim 9 wherein the device includes a control element for driving loading elements of said roll support arms.

19. The device of claim 9 wherein the signal proportional to roll diameter is obtained by the control unit by calculating roll diameter based on physical parameters selected from the group consisting of speed of the paper web, the acceleration of the paper web, paper caliper, paper density, core diameter and nip force.

* * * * *